US006919688B2

(12) United States Patent
Turcan

(10) Patent No.: US 6,919,688 B2
(45) Date of Patent: Jul. 19, 2005

(54) LUMINESCENT PLASMA DISCHARGE DEVICE, TIMEPIECE, HAVING CONTROLLED MOTION OF LUMINOUS DISCHARGE THROUGH MULTIPLE, INDEPENDENT DISCHARGE CHAMBERS

(76) Inventor: Silviu Turcan, 902-53 Thorncliffe Park Dr., Toronto, Ontario (CA), M4H 1L1

( * ) Notice: Subject to any disclaimer, the term of this patent is extended or adjusted under 35 U.S.C. 154(b) by 59 days.

(21) Appl. No.: 10/645,316

(22) Filed: Aug. 21, 2003

(65) Prior Publication Data

US 2004/0113552 A1 Jun. 17, 2004

Related U.S. Application Data

(60) Provisional application No. 60/444,223, filed on Feb. 3, 2003, and provisional application No. 60/407,821, filed on Aug. 21, 2002.

(51) Int. Cl.[7] ..... H05B 41/26; H01J 61/12; H01J 17/49

(52) U.S. Cl. ..... 315/58; 315/85; 315/248; 315/358; 315/361; 315/344; 313/582; 313/608; 313/637

(58) Field of Search ..... 315/58, 85, 248, 315/358, 185, 344, 361, 185 S; 313/582, 608, 637

(56) References Cited

U.S. PATENT DOCUMENTS 4,963,792 A * 10/1990 Parker ..... 315/58
5,909,086 A * 6/1999 Kim et al. ..... 315/111.21

* cited by examiner

*Primary Examiner*—Don Wang
*Assistant Examiner*—Chuc Tran

(57) ABSTRACT

A luminous discharge display device having two distinct, independent discharge chambers, stacked vertically; of substantially flat circular shape containing inert gas mixtures, and a central electrode coupled to a power supply which provides ionizing means for the gas. The device utilizes two grooves formed into defining members of the discharge chambers to increase the capacitance along their length due to the inverse relationship between dielectric width and capacitance. Two electrode assemblies are biased out of phase with respect to the main electrode further increasing the capacitance and converging the luminous discharge at that specific point and are fitted into the circular grooves. A clock mechanism moves the electrode assemblies along their respective grooves thus creating a controlled motion of the luminous glowing plasma.

5 Claims, 2 Drawing Sheets

LUMINESCENT PLASMA DISCHARGE DEVICE, TIMEPIECE, HAVING CONTROLLED MOTION OF LUMINOUS DISCHARGE THROUGH MULTIPLE, INDEPENDENT DISCHARGE CHAMBERS

REFERENCES TO RELATED APPLICATIONS

The disclosure described hereinbelow is related to provisional applications 60/407,821 dated Aug. 21, 2002 and 60/444,223 dated Feb. 3, 2003.

BACKGROUND OF THE DISCLOSURE

The present invention is in the field of flat plate luminous display devices utilizing a discharge through inert gas and more particularly to those devices having a moving pattern of light.

Nikola Tesla is the first inventor to make use of high voltage high frequency current to remotely induce a glowing discharge in glass vessels containing low pressure inert gases. Since then, a myriad of plasma display devices have been devised. These devices generally consist of a vitreous glass housing defining a chamber of spherical or flat shape. The discharge chamber will typically contain a low pressure inert gas such as neon with an activating impurity such as mercury vapour. The device will also have a centrally disposed electrode either protruding into or adjacent to the discharge area which is electrically coupled to a high voltage alternative current source with a cyclic rate above 20 kHz. When the voltage is applied, the high frequency ionizes the gas, forming a plasma through which a current flows by capacitive coupling to the surrounding area. The current re-establishes itself through a new path with every A/C cycle in a random fashion resulting in a pleasing moving luminous display. Particularly interesting effects are achieved by placing one's hand on the outside of the display surface. Due to the concentration of water and ions, the hand acts as a second conductive element of a capacitor thus partially diverting the discharge towards the point of contact resulting in an interactive kinetic light display.

It is an object of the present invention to provide a plasma display capable to fully control the motion of the luminous discharge by mechanical means so as to allow the construction of but not limited to a timepiece.

It is another object of the invention to provide a plasma display made up of multiple independent discharge chambers each hermetically sealed to contain its own gaseous mixture resulting in a multi-color, multi-effect display.

BRIEF DESCRIPTION OF THE DRAWINGS

In the drawings like characters of reference indicate corresponding parts in the different figures.

DETAILED DESCRIPTION OF THE PRESENT INVENTION

Figure 1:
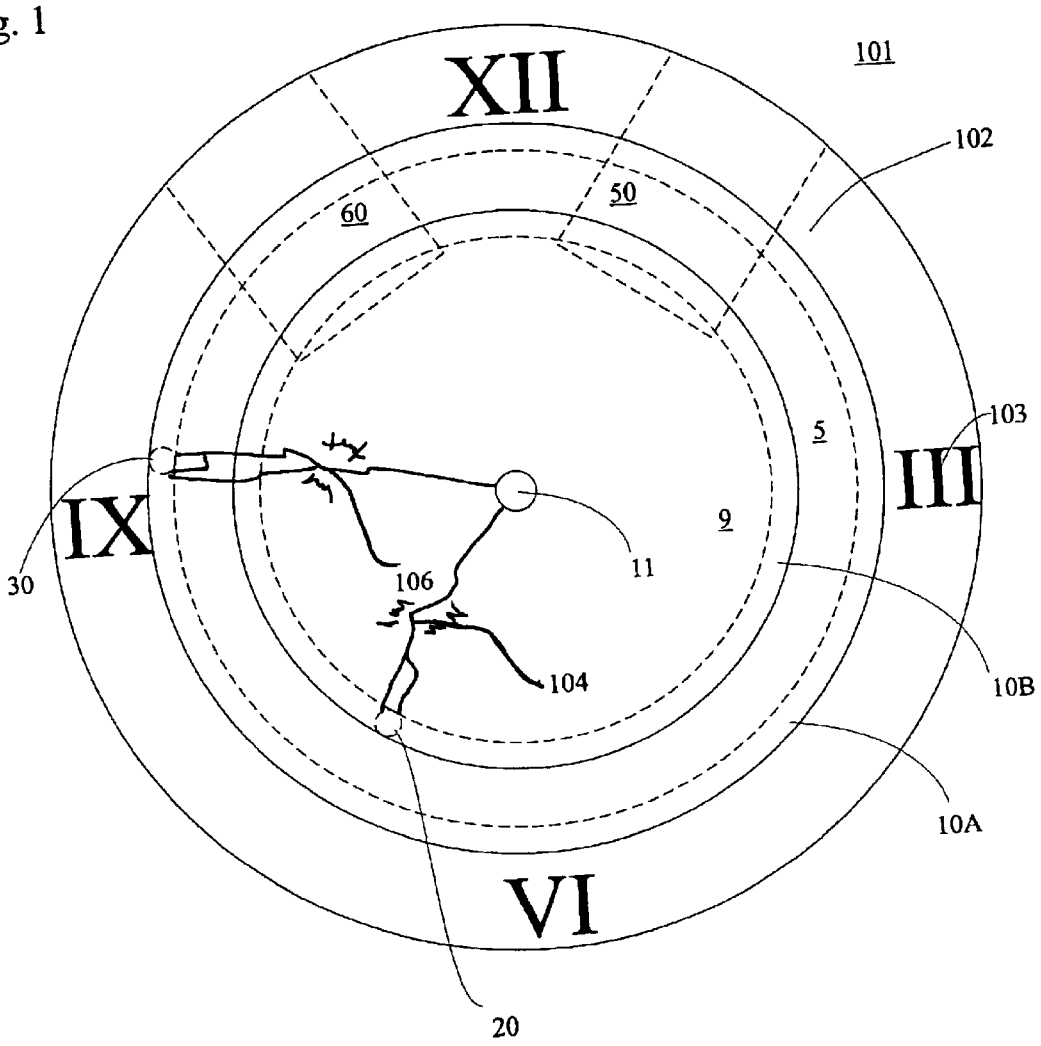
FIG. 1 shows the front view of a luminous clock made in accordance with the present invention.

The following is the best contemplated mode for carrying out the invention. Referring firstly to FIG. 1, there is seen the frontal view of a luminous plasma display clock made in accordance with the present invention is shown as front plate 101 with peripheral edge 102 bearing numerals 103 as in a standard 12 hour analog clock. The passage of time is indicated by the movement of clock hands 104 and 106 also as in a standard clock. Clock hand 104 is formed by a luminous plasma discharge through chamber 5 between electrode 11 and 21. clock hand 106 is formed by a luminous plasma discharge through chamber 9 between electrode 11 and 31. Electrodes 11, 21, and 31 are electrically coupled to power supply 50. Electrode 21 is mechanically coupled to clock drive mechanism 60 such that the mechanism causes electrode 21 to orbit about chamber 5 filled into groove 10 B as the small hand of a standard clock. Likewise electrode 31 is coupled to clock mechanism 60 such that the mechanism causes electrode 31 to orbit about chamber 9 fitted into groove 10 A in the same manner as the long hand of a clock.

Figure 2:
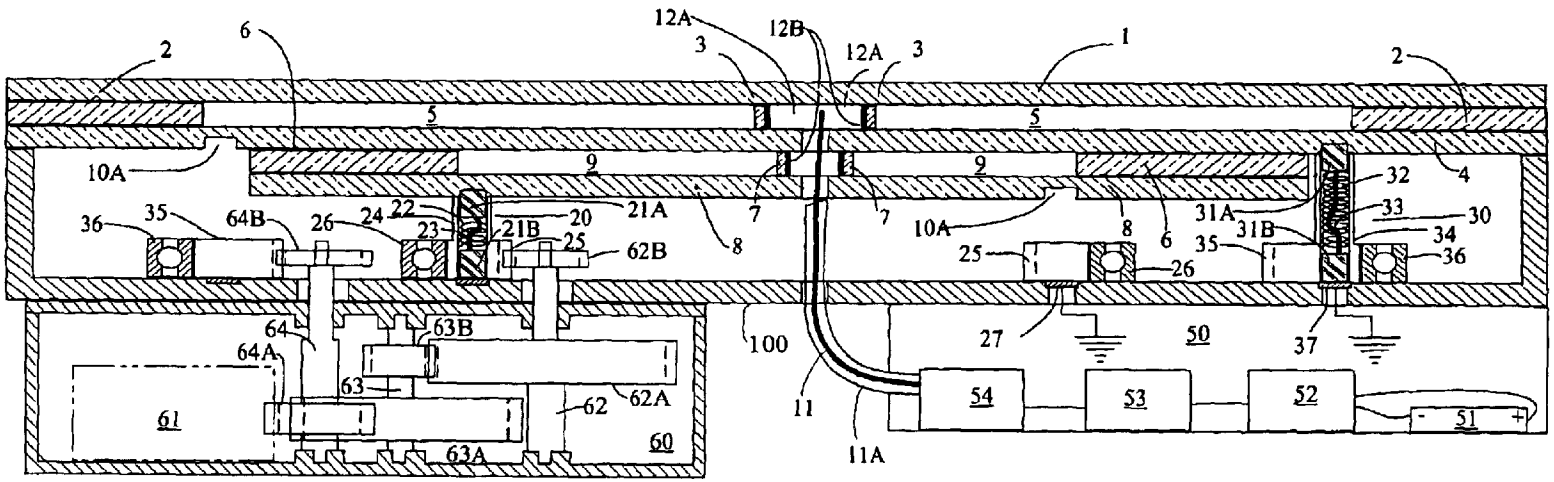
FIG. 2 is a cross-sectional view of the luminous clock shown in FIG. 1.

Referring now to FIGS. 1 and 2, chamber 5 is defined by annular flat plate 2 and tubular member 3 which are concentrically sandwiched between plates 1 and 4. Plate 1 can be of a perfect continuous shape, whereas plate 4 has a small centrally located opening and a circular groove channel 10A with outer edge coinciding with the inner edge of plate 2.

Chamber 9 is defined by annular flat plate 6 and tubular member 7 concentrically sandwiched between plates 4 and 8. Plates 6 and 8 are of substantially smaller circumference than plates 1,2 and 4. Plate 8 has a small central opening and a circular groove channel 10B with outer edge coinciding with the inner edge of plate 6. Grooves 10A and 10B serve the dual purpose of guiding the ground electrode assemblies and providing areas of increased capacitance due to the reduced thickness of the dielectric.

The comprising members are formed, cut, drilled; grooves 10A and 10B can be formed into plates 6 and 8 respectively by etching, grinding, sandblasting etc . . . The assembly is fused together by any conventional method such as heating at temperatures appropriate for fusion of glass in a gas fired oven or by means of glass frit such as Corning type 7575. Chambers 5 and 9 are also each provided tubes for evacuation and filling purposes in out of sight, un-conspicuous locations so as not to affect the aesthetic appearance of the finished device. Discharge areas 5 and 9 are then evacuated and backfilled with various gas mixtures including but not limited to pure gases or mixtures of noble gases with impurities such as carbon dioxide, mercury vapour, alcohol vapours, freons, phosphorous vapours etc . . . , at pressures ranging from a few milliTorr to one atmosphere depending on the desired effect. Since each chamber is individually hermetically sealed, each chamber may have its own mixture at a particular pressure which is different than the filling and pressure in the other resulting in a dual colour and effect display. The evacuation tubes may then themselves be hermetically sealed shut by means of softening and pinching or other means.

As it is well known in the art, central electrode 11 can either be protruding through the glass structure or as in the case of this particular embodiment, conductive high voltage wire 11 is inserted into housing 12A which has an internally disposed conductive layer 12B (on the inside surface of tubular members 3 and 7) Conductive layer 12B may be formed by any suitably conductive means such as conductive tape, stencil, paint, or metal oxide layer. A quantity of steel wool (not shown) is disposed within housing 12A to ensure multiple points of contact between electrode 11 and conductive layer 12B. Field shield 11A acts to prevent corona discharge form electrode 11 other than through discharge chambers.

High voltage wire 11 is connected to a power supply 50 which is configured to supply the electrode with an A/C signal in the kilovolt range at frequencies above 15 kHz.

When the signal is applied to electrode 11, the high frequency ionizes the gas which becomes the first conductive element of a capacitor with plates 1,4 and 8 acting as the dielectric. The capacitive coupling is drastically increased along grooves 11A and 11B due to the inverse relationship between dielectric thickness and capacitance. Electrode assemblies 20 and 30 act as the second conductive element. Changes in the location of the second element will affect the area of highest capacitive coupling converging the luminous plasma discharge at that specific point and may either grounded or electrically coupled to power supply 50 out of phase with respect to central electrode 11 further increasing the capacitance at the point of their location due to the attraction between opposing fields. As it is well known in the art power supply 50 may comprise a potential difference source 51 such as a battery or power cord adapted to be plugged into a standard 60 Hz A/C house outlet, current rectifying means 52, an oscillator 53, means of converting the voltage 54 such as a high turns ratio step up transformer or a flyback transformer, necessary safety components such as current limiting and failsafe circuitry (not shown).

Electrode assembly 20 is comprised of carbon brushes 21A and 21B, biasing spring 22, high voltage wire 23 contained in housing 24 which is formed on gear 25. Electrode assembly 30 is comprised of carbon brushes 31A and 31B, biasing spring 32, high voltage wire 33 contained in housing 24 which is formed on gear 35. Carbon brushes 21A and 31A are fitted into grooves 10A and 10B respectively and held in contact by biasing springs 22 and 32 respectively. Brushes 21A and 31A are electrically connected to brushes 21B and 31B through high voltage wires 23 and 33 respectively. Brushes 21B and 31B are held in contact with conductive rings 27 and 37 respectively by biasing springs 22 and 23 respectively. Conductive rings 27 and 37 allow for electrode assemblies 20 and 30 to be constantly electrically coupled to power supply 50 while the mechanism is turning.

In the presently described embodiment gears 25 and 35 preferably take the form of internal spur gears mounted to bearings 26 and 36 respectively which are in turn mounted on case 100. Internal gears 25 and 35 are mechanically coupled to and rotated by the motion of gears wheels 62 and 64 respectively.

In the drawing there may be seen a clock mechanism 60 which comprises of actuating mechanical means 61, gear 62, reduction gear 63, gear 64 and case 65. Actuating mechanism 61 is coupled to gear wheel 64A and configured to turn gear 64, said actuating means may consist of any suitable mechanical or electromechanical means, actual composition is not critical to the invention. Gear 62 comprises of shaft 62A gear wheels 62B and 62C; reduction gear comprises of shaft 63A and gear wheels 63B and 63C; gear 64 comprises shaft 64A gear wheels 64B and 64C. Gear wheel 64B is mechanically coupled to gear wheel 63B, gear wheel 63C is mechanically coupled to gear wheel 64B. The comprising gears wheels of clock mechanism 60 are configured in the following ratios: 62C:62B=1:4; 62B:63C=4:1; 63C:63B=1:3; 63B:64B=9:4. Given that the ratio of internal spur gears 25 to 35 is 3 to 4, internal gear 25 being coupled to gear wheel 62C and internal gear 35 is coupled to gear wheel 64C then the resulting angular velocity of electrode assembly 20 is one revolution per hour and that of electrode 30 is one twelfth of a revolution per hour.

Brushes 21A, 21B, 31A, and 31B are preferably made a suitable conductive material such as of carbon or graphite but not metal which tends to overheat and cause cracking of the glass at the point of convergence. Case 100, housings 24 and 34, springs 22 and 32, gears 25,27, 35 and 37 bearings 27 and 37 and shafts 28 and 38 as well as the mechanical parts and case of clock mechanism 60 are manufactured from plastic or a suitable non-conductive material such as PVC as to prevent the establishment of discharge arcs outside of discharge chambers 5 and 9. Internal gears 25 and 35 also serve the purpose of a field shield preventing the formation of corona discharge arcs directly from conductive rings 26 and 36 to chamber 9.

The present innovation has many advantages. The grounding electrodes are constructed of carbon or graphite which have high conductivity, low sliding friction, high infrared emisivitty and temperature expansion coefficient close to zero allowing for tracks and housings to be more simply constructed and in a variety of ways. Also in the preferred embodiment described hereinabove there is no communication between the chambers allowing for each chamber to contain its own gas or mixture of gasses at different pressures allowing for two distinct colors and or effects. The plates of the device can also be applied phosphorescent coating (activated by the ultraviolet part of the spectrum radiated by the excited plasma) with colours complimenting or contrasting the color of the luminous plasma resulting in a complex and mesmerising orchestrated display of energy and color. Furthermore, the number of electrodes can be varied, as well as their speed and direction relative to each other can be controlled and varied, the faceplates may be etched, stained or painted resulting in a wide range of different appearance and seemingly different functionality displays with minimum configuration.

It will be appreciated that there may be a variety of mechanical means to move the electrodes, including the main electrode; and various ways of grounding or electrically coupling the peripheral electrodes. The present embodiment is directed at a timepiece device, so a clock drive mechanism in combination with internal gears and bearings is suitable to move the electrodes. Many other embodiments can be readily created wherein the electrodes are moved by other mechanical means in order to create other types of motion.

Although the invention has been described and illustrated with respect to a presently preferred embodiment thereof, the description shall not be taken in limiting sense as the embodiments may take on different specific forms without departing from the true scope of the invention, the present invention being defined by the claims attached hereto.

What is claimed is:

1. A plasma discharge device comprising:

A. Two discharge chambers, each containing ionisable gas mixtures, stacked vertically on top of each other, B. A central electrode disposed adjacent to or protruding in the discharge region, C. Electrical means of ionizing the gas, said means being electrically coupled to including a power supply, said power supply comprising a battery, an oscillator and flyback transformer, D. Means for increasing the capacitance in specific regions of the discharge chambers in the form of circular tracks depressed into the dielectric structural walls, E. Means for converging the luminous discharge at a specific point including electrode assemblies fitted into the tracks, said electrodes being electrically biased out of phase with respect to central electrode, F. Means for moving the grounding electrode assemblies along their respective tracks including a mechanical mechanism.

2. A plasma discharge device according to claim 1 wherein said discharge chambers each comprise of two annular members, said members are sandwiched between two substantially flat circular dielectric plates.

3. A plasma discharge device according to claim 1 wherein said electrode assemblies each comprises of two carbon brush members, said carbon brush members are electrically coupled to each other through suitable wire means. Said carbon brush and said wire are contained in a housing, said housing is formed on an internal gear, said internal gear is anchored and pivoted on a bearing means, bearing means being adhesively connected to a case.

4. A plasma discharge device according to claim 3 wherein one of the said carbon brushes of said electrode assembly is fitted into a groove formed into a peripheral wall of the discharge chamber and the other said carbon brush member is in contact with a conductive ring, said conductive ring is adhesively connected to the said case.

5. A plasma discharge device according to claim 4 wherein said conductive ring is electrically connected to the said power supply.

* * * * *